US010195493B2

(12) United States Patent
Pinto

(10) Patent No.: US 10,195,493 B2
(45) Date of Patent: Feb. 5, 2019

(54) MULTIPLE LAYER BALL

(71) Applicant: TRIG GROUP, LLC, Dallas, TX (US)

(72) Inventor: Ademilson Pereira Pinto, Ribeírão Claro (BR)

(73) Assignee: Trig Group, LLC, Dallas, TX (US)

( * ) Notice: Subject to any disclaimer, the term of this patent is extended or adjusted under 35 U.S.C. 154(b) by 312 days.

(21) Appl. No.: 14/451,270

(22) Filed: Aug. 4, 2014

(65) Prior Publication Data

US 2016/0030813 A1 Feb. 4, 2016

(51) Int. Cl.

| | |
|---|---|
| ***A63B 41/10*** | (2006.01) |
| ***A63B 41/02*** | (2006.01) |
| *A63B 43/00* | (2006.01) |

(52) U.S. Cl.

CPC ..... *A63B 41/10* (2013.01); *A63B 41/02* (2013.01); *A63B 2043/001* (2013.01)

(58) Field of Classification Search

CPC ... A63B 41/00; A63B 43/00; A63B 2043/001; A63B 2208/12; A63B 2243/0025

See application file for complete search history.

(56) References Cited

U.S. PATENT DOCUMENTS

| | | | | |
|---|---|---|---|---|
| 4,169,594 | A * | 10/1979 | Crane | 473/604 |
| 5,772,545 | A * | 6/1998 | Ou | 473/605 |
| 6,039,662 | A * | 3/2000 | Chan | 473/604 |
| 6,402,647 | B1 * | 6/2002 | Haseltine | 473/605 |
| 6,656,067 | B2 * | 12/2003 | Ou | 473/605 |
| 6,971,965 | B1 * | 12/2005 | Shishido | 473/604 |
| 7,749,116 | B2 * | 7/2010 | Tang et al. | 473/604 |
| 8,991,033 | B1 * | 3/2015 | Hussain | 29/527.1 |
| 9,017,192 | B1 * | 4/2015 | Silva | 473/594 |
| 2003/0228946 | A1 * | 12/2003 | Chan | 473/604 |
| 2008/0242458 | A1 * | 10/2008 | Winn | 473/599 |
| 2009/0093327 | A1 * | 4/2009 | Maziarz et al. | 473/604 |
| 2013/0035182 | A1 * | 2/2013 | Sing | 473/605 |

* cited by examiner

*Primary Examiner* — Steven Wong

(74) *Attorney, Agent, or Firm* — Keith E. Taber

(57) ABSTRACT

A ball for small-sided play having the same characteristics as a standard soccer ball, but with reduced rebound and no added filler is disclosed.

20 Claims, 2 Drawing Sheets

MULTIPLE LAYER BALL

BACKGROUND

1. Field of the Invention

The present invention relates generally sports balls, such as those used to play, practice or train for soccer.

2. Description of Related Art

Soccer balls have very specific properties, such as weight, size, rebound, and pressure. The limit on these properties helps to insure that the ball in play, whether for practice or in a game, is largely the same no matter which ball is used. There are obvious quality and material differences between high priced and cheaper balls, but to be certified by the governing body, FIFA, the ball will have critical properties within a fairly tight range.

The current ball is designed for use on a large pitch, or field, that is 90-120 meters in length and 45-90 meters in width. Likewise, the number of players on the pitch is typically 11 players for each team. Therefore, the current ball is designed to be used by people who can secure a very large field and twenty-two players. While this is often possible, there are times where a small-sided game is preferred. Often for practice a game will be played between partial teams of less than 11 players on a smaller field. This has developed into a competitive sport of teams of three players each playing on a smaller pitch in tournaments between or even during their other soccer seasons. Because these are soccer players they use a standard soccer ball for this sort of short-sided game by default.

Problems occur when using a soccer ball in a short-sided game because the field of play is smaller but the ball bounces just as freely as it would on a larger field of play. Therefore, it can be difficult to prevent the ball from leaving the field of play, even for skilled players. Often several small-sided games may be happening on one larger practice field, so having the ball leave the field of play interrupts adjoining games or training sessions.

A need exists, therefore, for a sports ball that is designed to be similar to a soccer ball but designed for play in a small-sided environment on turf, whether natural or artificial.

All references cited herein are incorporated by reference to the maximum extent allowable by law. To the extent a reference may not be fully incorporated herein, it is incorporated by reference for background purposes and indicative of the knowledge of one of ordinary skill in the art.

BRIEF SUMMARY OF THE INVENTION

The problems presented by small-sided soccer play are addressed by providing a ball whose characteristics are similar to a regulation soccer ball, but designed for small-sided play on turf. One way to increase the suitability for small-sided play is to reduce the rebound of the ball into a range below that used for soccer but higher than that used for play on hard surfaces, such as futsal.

Other objects, features, and advantages of the present invention will become apparent with reference to the drawings and detailed description that follow.

DETAILED DESCRIPTION

Figure 1:
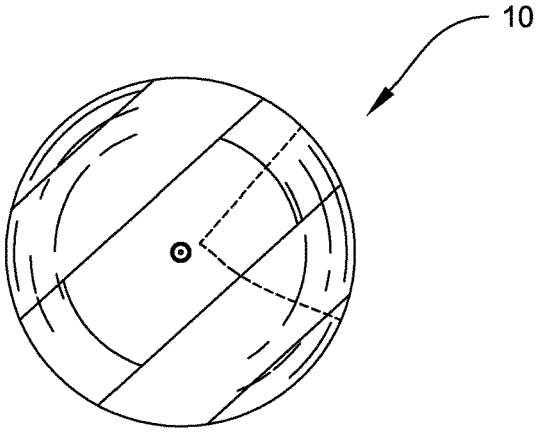
FIG. 1 is a perspective view of a ball with a dashed line showing where the section is taken for FIG. 2.

All references cited herein are incorporated by reference to the maximum extent allowable by law. To the extent a reference may not be fully incorporated herein, it is incorporated by reference for background purposes and indicative of the knowledge of one of ordinary skill in the art.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical mechanical and electrical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

The International Federation of Association Football, known as FIFA, is the international governing body for the sport known in the United States as soccer, as well as two soccer like sports: beach soccer and futsal. As such FIFA has developed criteria for equipment in each of these sports. For balls they have set out the following criteria: circumference, roundness, rebound, water absorption, weight, pressure loss, shape and size retention, and balance. Balance is only a criterion for futsal balls because it is played on a hard surface and minor imbalance can change the direction of the ball on a hard surface. The remainder of the criteria are applied to all FIFA balls, either to an "inspected" standard or a more demanding "approved" standard. For soccer there are only "inspected" standards for the smaller size 4 ball, as will be reflected in the tables below.

TABLE 1

| Circumference | | |
|---|---|---|
| Circumference | APPROVED | INSPECTED |
| Outdoor - Size 5 | 68.5-69.5 cm | 68.0-70.0 cm |
| Outdoor - Size 4 | — | 63.5-66.0 cm |
| Beach soccer | 68.0-70.0 cm | 68.0-70.0 cm |
| Futsal | 62.5-63.5 cm | 62.0-64.0 cm |

TABLE 2

| Roundness | | |
|---|---|---|
| Roundness | APPROVED | INSPECTED |
| Outdoor - Size 5 | maximum 1.5% | maximum 1.8% |
| Outdoor - Size 4 | — | maximum 1.8% |
| Beach soccer | maximum 1.8% | maximum 1.8% |
| Futsal | maximum 1.5% | maximum 1.8% |

TABLE 3

| Rebound | | | |
|---|---|---|---|
| Rebound | | APPROVED | INSPECTED |
| Outdoor - Size 5 | at 20° C. | 135-155 cm | 125-155 cm |
| | at 05° C. | minimum 125 cm | minimum 115 cm |
| Outdoor - Size 4 | at 20° C. | — | 115-155 cm |
| | at 05° C. | — | minimum 115 cm |
| Beach soccer | | 100-150 cm | 100-150 cm |
| Futsal | | 55-65 cm | 50-65 cm |

TABLE 4

| Water Absorption | | | |
|---|---|---|---|
| Water Absorption | | APPROVED | INSPECTED |
| Outdoor - Size 5 | Average water uptake of the initial weight of the tested balls: | 10% | 15% |
| | Maximum water uptake per ball not to exceed: | 15% | 20% |
| Outdoor - Size 4 | Average water uptake of the initial weight of the tested balls: | — | 15% |
| | Maximum water uptake per ball not to exceed: | — | 20% |
| Beach soccer | Maximum water uptake per ball not to exceed: | 10% | 15% |

TABLE 5

| Weight | | |
|---|---|---|
| Weight | APPROVED | INSPECTED |
| Outdoor - Size 5 | 420-445 grams | 410-450 grams |
| Outdoor - Size 4 | — | 350-390 grams |
| Beach soccer | 420-440 grams | 400-440 grams |
| Futsal | 410-430 grams | 400-440 grams |

TABLE 6

| Pressure Loss | | |
|---|---|---|
| Pressure Loss | APPROVED | INSPECTED |
| Outdoor - Size 5 | maximum 20% | maximum 25% |
| Outdoor - Size 4 | — | maximum 25% |
| Beach soccer | maximum 20% | maximum 25% |
| Futsal | maximum 20% | maximum 25% |

TABLE 7

| Shape and Size Retention | | |
|---|---|---|
| Shape and Size Retention | APPROVED | INSPECTED |
| Outdoor - Size 5 | | |
| Increase in circumference | maximum 1.5 cm | — |
| Deviation on sphericity | maximum 1.5% | — |
| Change of pressure | maximum 0.1 bar | — |
| Beach Soccer | | |
| Increase in circumference | maximum 1.5 cm | — |
| Deviation on sphericity | maximum 2% | — |
| Change of pressure | maximum 0.1 bar | — |

TABLE 7-continued

| Shape and Size Retention | | |
|---|---|---|
| Shape and Size Retention | APPROVED | INSPECTED |
| Futsal | | |
| Increase in circumference | maximum 1.0 cm | — |
| Deviation on sphericity | maximum 1.5% | — |
| Change of pressure | maximum 0.1 bar | — |

The test methods for each of the criteria above are available online from FIFA. In particular, for the rebound test the balls are dropped ten times onto a steel plate from a height of two meters. Under controlled temperature conditions, the balls must rebound consistently and within the range listed in Table 3 for each type of ball and each type of certification. For the purposes of this patent the word "rebound" will mean the value derived from this FIFA test procedure.

Figure 2:
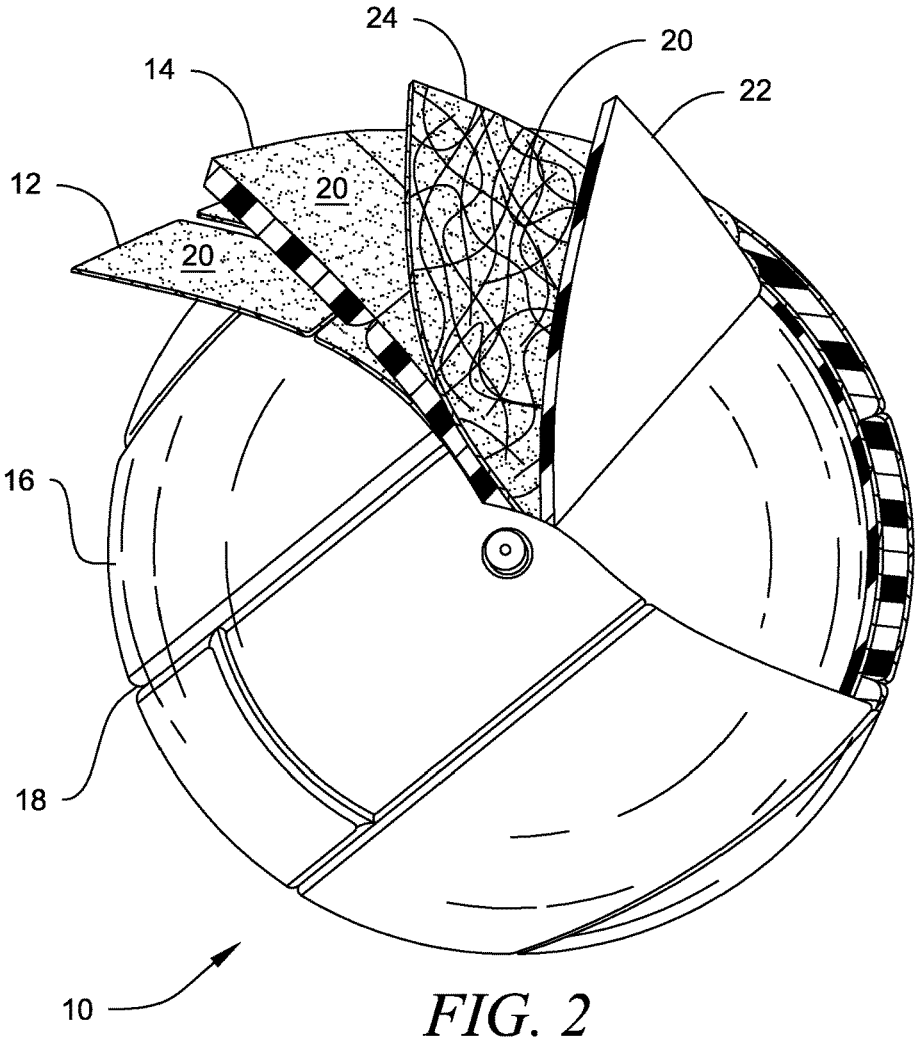
FIG. 2 is a sectional view of the ball of FIG. 1.

FIG. 1 is a perspective view of a ball 10 with a dashed line showing where the section is taken for FIG. 2. Ball 10 is preferably of a regulation size, such as size 5 for adult play or a smaller accepted size for youth play, such as size 4. As such ball 10 will preferably have a circumference that falls within the ranges stated above for size 4 and size 5 soccer balls. Ball 10 will also preferably be the same weight as a standard soccer ball according to its size as stated above. Ball 10 will preferably meet all of the requirements of a ball listed in the tables above for the respective size of ball 10 except for rebound.

A size 5 version of ball 10 will have a rebound closer to 90 cm at 20° C., with range as low as 66 cm and as high as 99 cm at 20° C. A competition version of a size 5 ball 10 may have tighter range for rebound of between 80 cm and 95 cm at 20° C. A quality training version of a size 5 ball 10 may have a slighter wider range of rebound extending from 70 cm to 97 cm at 20° C. The minimum rebound at 5° C. for a size 5 ball 10 will be at least 55 cm.

A size 4 version of ball 10 will have a rebound closer to 85 cm at 20° C., with range as low as 66 cm and as high as 99 cm at 20° C. A competition version of a size 4 ball 10 may have tighter range for rebound of between 75 cm and 90 cm at 20° C. A quality training version of a size 4 ball 10 may have a slighter wider range of rebound extending from 67 cm to 95 cm at 20° C. The minimum rebound at 5° C. for a size 4 ball 10 will be at least 55 cm.

FIG. 2 is a sectional view of ball 10 of FIG. 1 showing how a reduced rebound can be achieved without interfering with the other criteria. Ball 10 is designed to reduce rebound without adding filling to the bladder or impacting the other criteria. This results in ball 10 feeling very similar to a regulation soccer ball so that the player does not have to adjust when moving from small-sided play to full pitch soccer. Playing small-sided with ball 10 is more similar to full pitch soccer than futsal, thus reducing any adjustment a player may need to make who is playing both or who is playing soccer primarily and the other sport as a training aid. A futsal ball is filled with material to reduce rebound significantly and the skin of the futsal ball is optimized to play on a solid surface while ball 10 retains a soccer like skin 12 because it will be played on soccer like surfaces, such as turf.

Ball 10 has a skin 12 with a backing 14 to create panels 16 with seams 18 between panels 16. Ball 10 is shown in an 8-panel design, but other panel designs may work as well, and there are numerous panel designs known in the art. Skin 12 is made of polyurethane (PU) or poly vinyl chloride (PVC), or other synthetic materials with similar characteristics. Backing 14 may be a foam layer made of a synthetic rubber, such as ethylene vinyl acetate (EVA). The panels 16 may be sewn together at seams 18 or may be thermally bonded, or bonded through other means that give a suitable result. Skin 12 is bonded to backing 14 by an adhesive 20, such as contact cement or thermally activated adhesives or other suitable adhesive that maintain adhesion and flexibility.

Ball 10 has a bladder 22 and a lining 24, bladder 22 being the innermost layer of construction and lining 24 being between bladder 22 and backing 14. Bladder 22 may be made of vinyl, latex, butyl, or PU, but will be different from a soccer ball bladder. Typical soccer ball bladders are approximately 150 grams for a size 5 and 120 grams for a size 4. In contrast ball 10 will have a bladder 22 that weighs about 180 grams for a size 5 and 160 grams for a size 4. This increased bladder weight helps to reduce the rebound of ball 10 as compared to a standard soccer ball. Because ball 10 still weighs about the same as a soccer ball, the weight for the lining 24 may be reduced and amount of adhesive 20 may be reduced. Some soccer balls may have multiple lining layers or may have one thick lining layer, ball 10 has a relatively thin lining 24 that is made of randomly wound synthetic fibers, such as polyester fibers.

Figure 3:
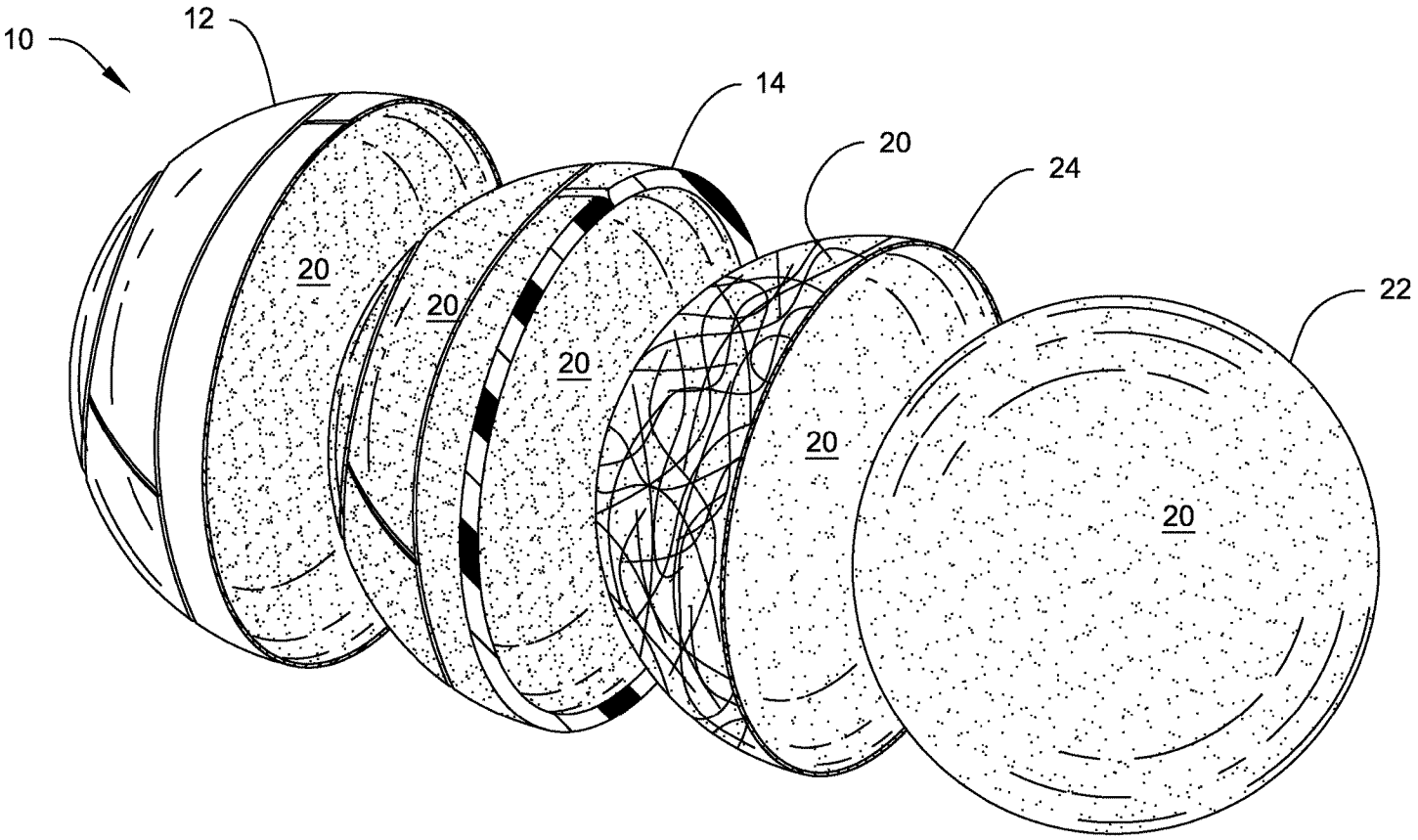
FIG. 3 is an exploded view of the ball of FIG. 1.

FIG. 3 is an exploded view of the ball 10 of FIGS. 1 and 2. This view allows for more discussion of how ball 10 may be assembled achieving a target rebound without adding fiber insider bladder 22. Lining 24 covers bladder 22. Lining 24 may be applied as hot synthetic fibers that bond directly to bladder 22 or an adhesive 20 may be applied to bladder 22 and an interior surface of lining 24 to create a bond between lining 24 and bladder 22.

Backing 14 may be bonded to skin 12 by an adhesive 20. Adhesive 20 may be applied to the interior of skin 12 and the facing surface of backing 14 to create a strong bond between backing 14 and skin 12. Backing 14 may then be bonded to lining 24 with an adhesive applied to the opposing surfaces of lining 24 and backing 14 to create a durable bond. Adhesive 20 may be reduced as compared to a soccer ball to reduce weight so that ball 10 will still meet the weight criteria in the tables above.

It should be apparent from the foregoing that an invention having significant advantages has been provided. While the invention is shown in only a few of its forms, it is not just limited but is susceptible to various changes and modifications without departing from the spirit thereof. For example a size 3 ball 10 may be made in accordance with this disclosure, but with a circumference or 58 cm to 61 cm and weight of 350 grams to 380 grams, but 130 gram bladder 22 instead of the standard 110 grams used in a size 3 soccer ball and the lining 24 and adhesive 20 reduced appropriately to maintain a standard size 3 weight. A size 3 ball 10 would then have a rebound closer to 90 cm at 20° C., with a range as low as 66 cm and as high as 99 cm at 20° C. A competition version of a size 3 ball 10 may have a tighter range for rebound of between 75 cm and 90 cm at 20° C. A training version of a size 3 ball 10 may have a wider range of rebound extending from 65 cm to 95 cm at 20° C. The minimum rebound at 5° C. for a size 3 ball 10 will be at least 50 cm.

I claim:

1. A ball comprising:
a bladder;
a lining attached to the bladder;
panels attached to the lining, the panels being made of a skin and a backing layer;
the ball having a circumference between 68 cm and 70 cm and a weight of 410 grams to 450 grams and a rebound in the range of 70 cm to 97 cm at 20° C.

2. The ball of claim 1 wherein:
the bladder weighs about 180 grams.

3. The ball of claim 2 wherein:
the rebound is in the range of 75 cm to 95 cm at 20° C.

4. The ball of claim 1 wherein:
the rebound is in the range of 80 cm to 95 cm at 20° C.

5. The ball of claim 2 wherein:
the rebound is in the range of 80 cm to 90 cm at 20° C.

6. The ball of claim 1 wherein:
the rebound is in the range of 85 cm to 90 cm at 20° C.

7. The ball of claim 2 wherein:
the minimum rebound at 5° C. is at least 55 cm.

8. The ball of claim 1 wherein:
the ball has a circumference between 68.5 cm and 69.5 cm and a weight of 420 grams to 445 grams and a rebound in the range of 80 cm to 95 cm at 20° C.

9. The ball of claim 8 wherein:
the bladder weighs about 180 grams.

10. The ball of claim 8 wherein:
the rebound is in the range of 85 cm to 90 cm at 20° C.

11. The ball of claim 9 wherein:
the rebound is in the range of 85 cm to 95 cm at 20° C.

12. The ball of claim 8 wherein:
the rebound is in the range of 80 cm to 90 cm at 20° C.

13. The ball of claim 9 wherein:
the rebound is in the range of 85 cm to 90 cm at 20° C.

14. The ball of claim 9 wherein:
the minimum rebound at 5° C. is at least 55 cm.

15. A ball comprising:
a bladder;
a lining attached to the bladder,
panels attached to the lining, the panels being made of a skin and a backing layer the ball having a circumference between 58 cm and 61 cm and a weight of 350 grams to 380 grams and a rebound in the range of 65 cm to 95 cm at 20° C.

16. The ball of claim 15 wherein:
the bladder weighs about 130 grams.

17. The ball of claim 16 wherein:
the rebound is in the range of 75 cm to 90 cm at 20° C.

18. The ball of claim 15 wherein:
the rebound is in the range of 65 cm to 95 cm at 20° C.

19. The ball of claim 16 wherein:
the rebound is in the range of 65 cm to 95 cm at 20° C.

20. The ball of claim 16 wherein:
the minimum rebound at 5° C. is at least 50.

* * * * *